US008185010B2

(12) United States Patent
Kuze et al.

(10) Patent No.: US 8,185,010 B2
(45) Date of Patent: May 22, 2012

(54) CHARGING WIRE CLEANING APPARATUS

(75) Inventors: Masato Kuze, Yamato-Koriyama (JP); Hirokazu Yamauchi, Uji (JP); Toshiki Takiguchi, Yamato-Koriyama (JP); Kazuhiro Matsuyama, Ikoma (JP); Hiroyuki Murai, Yamato-Koriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 932 days.

(21) Appl. No.: 12/202,482

(22) Filed: Sep. 2, 2008

(65) Prior Publication Data

US 2009/0074444 A1 Mar. 19, 2009

(30) Foreign Application Priority Data

Sep. 18, 2007 (JP) ..... 2007-240615

(51) Int. Cl.
*G03G 15/02* (2006.01)

(52) U.S. Cl. ..... 399/100

(58) Field of Classification Search ..... 399/100, 399/101, 98, 99

See application file for complete search history.

(56) References Cited

U.S. PATENT DOCUMENTS

| | | | | |
|---|---|---|---|---|
| 4,908,513 | A * | 3/1990 | Masuda et al. | 399/100 |
| 4,924,268 | A * | 5/1990 | Ogura | 399/99 |
| 4,956,671 | A * | 9/1990 | Otsuka | 399/100 |
| 5,012,093 | A * | 4/1991 | Shimizu | 399/100 |
| 5,089,850 | A * | 2/1992 | Ogura et al. | 399/99 |
| 6,819,893 | B2 * | 11/2004 | Kikuchi | 399/100 |
| 7,623,806 | B2 * | 11/2009 | Tanase | 399/100 |

FOREIGN PATENT DOCUMENTS

| | | |
|---|---|---|
| JP | 63-204269 | 8/1988 |
| JP | 01-223476 | 9/1989 |
| JP | 07-199605 | 8/1995 |
| JP | 08-015963 | 1/1996 |
| JP | 09-134059 | 5/1997 |

* cited by examiner

*Primary Examiner* — Sandra Brase

(74) *Attorney, Agent, or Firm* — Renner, Otto, Boisselle & Sklar, LLP

(57) ABSTRACT

Cleaning performance of a cleaning pad for cleaning a charging wire is maintained so that the charging voltage of an image carrier by a charging wire is stabilized. A charging wire cleaning apparatus is provided with a cleaning pad for cleaning a charging wire which charges an image carrier, a slider which is a supporting body for supporting the cleaning pad, and a screw shaft which is a moving mechanism for reciprocating the slider in parallel to the charging wire. When the slider is at a predetermined position of the reciprocation range, the cleaning pad and the charging wire are separated, and the cleaning pad is adapted to be shifted with respect to the charging wire in this state.

18 Claims, 8 Drawing Sheets

CHARGING WIRE CLEANING APPARATUS

CROSS-NOTING PARAGRAPH

This Non-provisional application claims priority under 35 U.S.C. §119(a) on Patent Application No. 2007-240615 filed in JAPAN on Sep. 18, 2007, the entire contents of which are hereby incorporated herein by reference.

FIELD OF THE INVENTION

The present invention relates to a charging wire cleaning apparatus, and more specifically to a charging wire cleaning apparatus for cleaning a charging wire of a charging apparatus used for an image forming apparatus such as a FAX, a printer, and a multi-functional peripheral.

BACKGROUND OF THE INVENTION

In an image forming apparatus such as a FAX, a printer, and a multi-functional peripheral, a surface of an image carrier such as a photoreceptor drum, which is charged uniformly, is exposed with light to form an electrostatic latent image, the electrostatic latent image is developed so as to be visualized, and the visualized image is transferred onto a recording paper or the like, resulting that a record image is obtained.

In such an image forming apparatus, a corona discharge apparatus (a main charger) provided with a charging wire as an electrode for discharge is generally used in order to charge the image carrier before exposure.

Moreover, the image forming apparatus is provided with a charging wire cleaning apparatus for cleaning a charging wire which gets dirt with the passage of time as it is used. As the charging wire cleaning apparatus, one that is configured so as to clean a charging wire by reciprocating a supporting body for supporting a cleaning pad to slide the charging wire has been known.

Concerning such a cleaning apparatus for a charging wire using corona discharge, Japanese Laid-Open Patent Publication No. 1-223476 discloses a cleaning apparatus for cleaning a charging wire with a cleaning pad. The cleaning apparatus is composed of a cleaner unit which carries two pieces of the cleaner pads that slide each charging wire, respectively, a driving screw for moving it along the charging wire, and a driving motor for driving the driving screw.

Since a conventional cleaning pad is fixed to a supporting body that reciprocates, there is a problem of causing abrasion and damage of the cleaning pad by sliding along a charging wire, resulting that cleaning performance is lowered.

SUMMARY OF THE INVENTION

An object of the present invention is to provide a charging wire cleaning apparatus wherein the cleaning performance of a cleaning pad for cleaning a charging wire is maintained so that charging voltage of an image carrier by the charging wire can be stabilized.

Another object of the present invention is to provide a charging wire cleaning apparatus, comprising a cleaning pad for cleaning a charging wire which charges an image carrier; a supporting body for supporting the cleaning pad; and a moving mechanism for reciprocating the supporting body in parallel to the charging wire, wherein the charging wire cleaning apparatus has a mechanism for making the cleaning pad and the charging wire in a separated state when the supporting body is at a predetermined position within a reciprocation range, and the supporting body is adapted to shift the cleaning pad with respect to the charging wire when they are separated.

Another object of the present invention is to provide the charging wire cleaning apparatus, wherein two pieces of the cleaning pads are provided for one piece of the charging wire.

Another object of the present invention is to provide the charging wire cleaning apparatus, wherein the two pieces of the cleaning pads provided in the one piece of the charging wire are arranged so as to be brought into contact with the charging wire at a position separated each other on the charging wire, in which one of the cleaning pads is brought into contact with the charging wire from one side, and the other cleaning pad is brought into contact with the charging wire from a side opposite to the one side.

Another object of the present invention is to provide the charging wire cleaning apparatus, wherein the supporting body has a base portion which is reciprocated by the moving mechanism and a head portion which is pivotally supported so as to be rotatable with respect to the base portion, the cleaning pad is attached to the head portion, and depending on a rotation of the head portion, a position where the cleaning pad is brought into contact with the charging wire and a position where the cleaning pad is separated from the charging wire are taken.

Another object of the present invention is to provide the charging wire cleaning apparatus, wherein the mechanism that causes the cleaning pad to be separated from the charging wire has a fixing wall portion which acts on the head portion only when the supporting body is positioned at the predetermined position within the reciprocation range, and at the predetermined position, the fixing wall portion displaces the head portion in a predetermined direction so as to rotate the head portion, and thereby the cleaning pad and the charging wire are kept being in a separated state.

Another object of the present invention is to provide the charging wire cleaning apparatus, wherein the head portion is shiftably attached to the base portion, the charging wire cleaning apparatus has a shift operation member which can be engaged with a part of the head portion to enable a shift operation in a predetermined direction only when the supporting body is positioned at the predetermined position within the reciprocation range, and when an operation of shifting the shift operation member at the predetermined position is performed, the head portion is shifted with the shift operation member, and the cleaning pad is shifted with respect to the charging wire.

Another object of the present invention is to provide the charging wire cleaning apparatus, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal face.

Another object of the present invention is to provide the charging wire cleaning apparatus, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

PREFERRED EMBODIMENTS OF THE INVENTION

Figure 1:
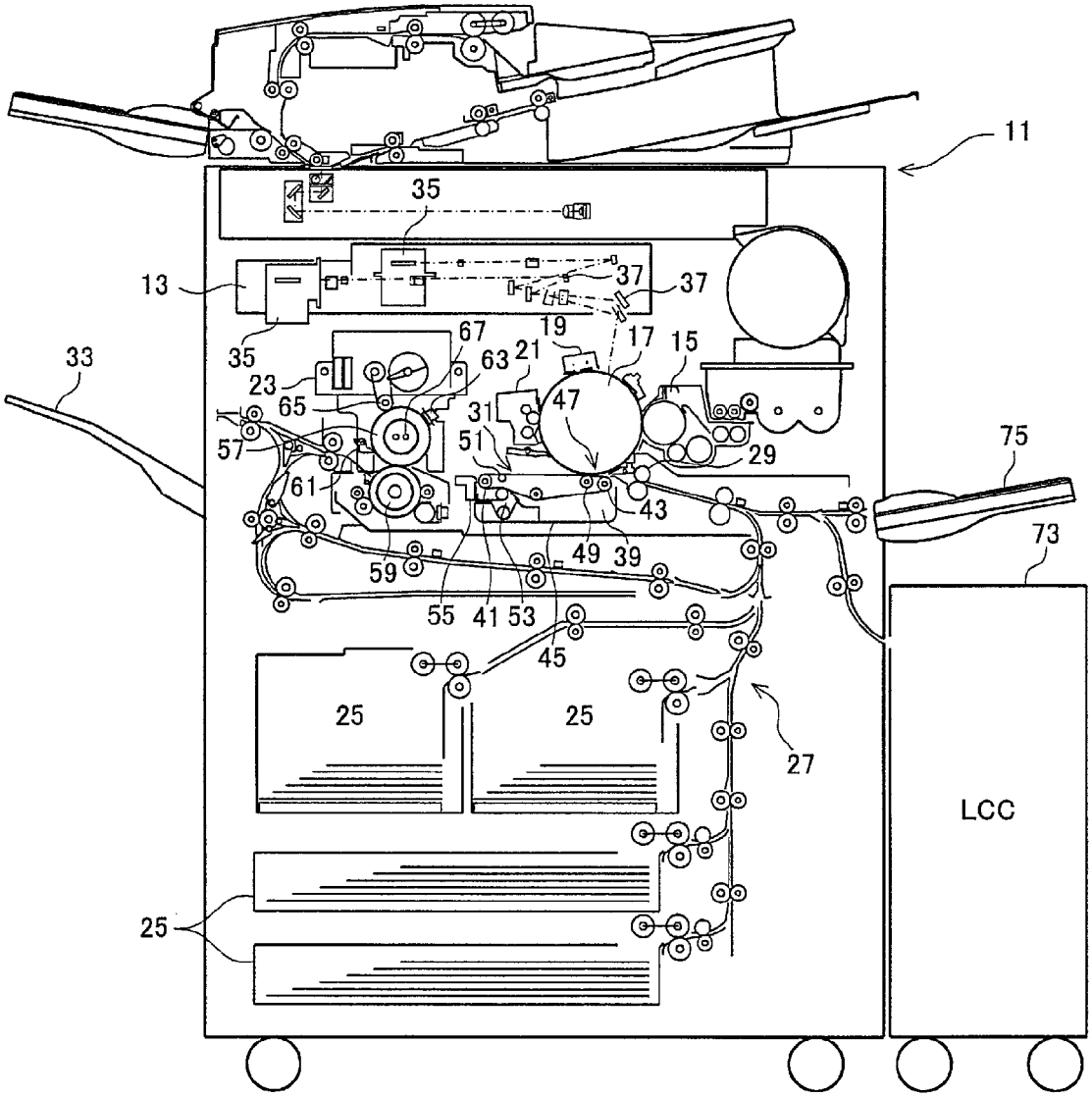
FIG. 1 is a view showing a structural example of an image forming apparatus to which a charging wire cleaning apparatus of the present invention can be applied.

FIG. 1 is a view showing a structural example of an image forming apparatus to which a charging wire cleaning apparatus of the present invention can be applied. The image forming apparatus 11 shown in FIG. 1 forms a monochrome image on a predetermined sheet (a recording paper) in accordance with image data received from the outside.

The image forming apparatus 11 is provided with an exposure unit 13, a developing device 15, a photoreceptor drum 17, a charging apparatus 19, a cleaner unit 21, a fixing unit 23, a paper feed tray 25, and a paper discharge tray 33. Moreover, a paper feed and transport path 27 which extends upward from the paper feed tray 25 and a paper transport path 31 for transporting sheets to the paper discharge tray 33 from the terminating end of the paper feed and transport path 27 are provided. A sheet transported on the paper transport path 31 is discharged to the paper discharge tray 33 through a resist roller 29, a transfer belt 45, and the fixing unit 23.

The charging apparatus 19 is charging means for uniformly charging a surface of the photoreceptor drum 17 at a predetermined voltage, in which a charging apparatus of a charger type provided with a charging wire as a discharge electrode is used. In order to clean the charging wire, the charging wire cleaning apparatus according to the present invention is provided. A specific structural example of the charging wire cleaning apparatus will be described below.

The exposure unit 13 uses a laser scanning unit (LSU) including a laser irradiation portion 35 and a reflection mirror 37. In addition, there is a method of using, for example, an EL or LED writing head in which light-emitting elements are arranged in an array, as the exposure unit 13.

Furthermore, the image forming apparatus 11 of the present embodiment uses a plurality of laser beams in order to perform high-speed printing processing, and employs a two-beam method to alleviate speeding up of irradiation timings. In addition, the image forming apparatus 11 has a function of exposing the photoreceptor drum 17 which is charged uniformly by the charging apparatus 19 with light depending on input image data so as to form an electrostatic latent image in accordance with the image data on the surface of the photoreceptor drum 17. The photoreceptor drum 17 is an image carrier which carries an image by the electrostatic latent image.

The developing device 15 visualizes the electrostatic latent image formed on the photoreceptor drum 17 with toner. The cleaner unit 21 removes and collects residual toner on the surface of the photoreceptor drum 17 after development and image transfer.

The toner visualized on the photoreceptor drum 17 as described above is transferred on a sheet being transported on the paper transport path 31. Thus, a transfer mechanism 39 (a unit comprising the transfer belt 45) is a mechanism for applying an electric field having an opposite polarity to that of the electric charge of the toner to transfer the toner on the sheet. For example, when the electrostatic image bears negative charge, the applied polarity to the transfer mechanism 39 is positive.

The transfer mechanism 39 of the image forming apparatus 11 is bridged with a drive roller 41, a driven roller 43, and other rollers, and is provided with the transfer belt 45 which has a predetermined resistivity (ranging from $1\times10^{9}$ to $1\times10^{13}\Omega\cdot$cm). Moreover, separately from the drive roller 41 and the driven roller 43, an elastic conductive roller 49 which can apply a transfer electric field to the transfer belt 45 is arranged at a contact part 47 of the photoreceptor drum 17 and the transfer belt 45. The elastic conductive roller 49 has elasticity. With this elasticity, the photoreceptor drum 17 and the transfer belt 45 have face contact with a predetermined width (called a transfer nip portion), not line contact. Thus, it is possible to improve the efficiency of transfer to a sheet to be transported.

Furthermore, on the downstream of the transfer area of the transfer belt 45, a discharging roller 51 for neutralizing the sheet charged by the applied voltage when the sheet passes through the contact part 47 to make the sheet smoothly transported to the next process is arranged. The discharging roller 51 is disposed on the back face of the transfer belt 45.

In addition, the transfer mechanism 39 is provided with a cleaning unit 53 for removing dirt of toner on the transfer belt 45 and a discharging mechanism 55 for neutralizing the transfer belt 45. The discharging mechanism 55 employs a method of connecting the apparatus to the ground or a method of positively applying an electric field having the polarity opposite to that of the transfer electric field. The toner transferred on the sheet in the transfer mechanism 39 is transported to the fixing unit 23.

The fixing unit 23 is provided with a heat roller 57 and a pressure roller 59, and a sheet separation claw 61, a roller surface temperature detecting member (thermistor) 63, and a roller surface cleaning member 65 are arranged on the outer periphery of the heat roller 57. Moreover, a heat source 67 for heating the heat roller surface at a predetermined temperature (set fixing temperature: approximately 160 to 200 deg.) is arranged in the interior part of the heat roller 57.

On the other hand, a pressing member capable of abutting the pressure roller 59 with a predetermined pressure against the heat roller 57 is arranged at both ends of the pressure roller 59, and further a sheet separation claw and a roller surface cleaning member are disposed on the outer periphery of the pressure roller 59, similarly to the outer periphery of heat roller 57.

In the fixing unit 23, the unfixed toner on the sheet being transported is heated and fused at a temperature of the surface of the heat roller 57 in the pressurized contact portion (fixing nip portion) between the heat roller 57 and the pressure roller 59, and the unfixed toner on the sheet is fixed by the anchoring effect with the pressing force from the heat roller 57.

The paper feed tray 25 is a tray for stacking sheets (recording papers) used for forming images, and is provided in the lower side of an image forming portion and a side wall face in the apparatus. Since the apparatus is aimed at performing high-speed printing processing, a plurality of paper feed trays 25 each capable of stacking 500 to 1500 standard-sized sheets are arranged under the image forming portion. Further, a large-capacity paper feed cassette 73 capable of storing a plurality kinds of sheets in large volumes and a manual feed tray 75 which is mainly used for performing printing on non-standard-sized sheets are arranged at the side of the apparatus.

Although the paper discharge tray 33 is arranged on the side face of the apparatus opposite to the manual feed tray 75, instead of the paper discharge tray 33, a post-processing device for paper discharge (stapling, punching and other processing) and a multi-stage paper discharge tray 33 can be arranged as an option.

In addition, the image forming apparatus 11 includes a not-shown control portion. The control portion controls the operation of the image forming apparatus 11, and is composed of, for example, a microcomputer, a ROM which stores a control program as a procedure of processing executed by the microcomputer, a RAM which provides a work area for operations, a nonvolatile memory which stores data necessary for control as a backup, an input circuit to which input signals from a sensor and a switch are connected and which includes an input buffer and an A/D conversion circuit, an output circuit which includes a driver for driving a motor, a solenoid, a lamp and the like.

A sheet transport step corresponding to a processing mode of the image forming apparatus 11 will be described. By the microcomputer in the control portion, a sheet adaptable to a printing request is selected from the plurality of paper feeding trays 25, and transported to the resist roller 29 and temporarily stopped.

The microcomputer causes the resist roller 29 to re-rotate at the timing so that the tip of the sheet is adjusted to the image information on the photoconductor drum 17, and thereby the sheet is transported to the transfer mechanism 39. In the transfer mechanism 39, the toner corresponding to the image information is transferred onto the sheet, and thereafter the sheet is guided to the fixing unit 23 and the toner is fixed on the sheet. Subsequently, the sheet is discharged to the paper discharge tray 33.

The microcomputer controls a sheet transport method over the fixing unit 23 to the paper discharge tray 33 depending on a printing mode (a copier mode, a printer mode, a FAX mode, or the like) and a printing processing method (simplex printing, duplex printing, or the like). Usually, in the copier mode, a user performs operations near the apparatus, and therefore sheet transporting control is often performed so that a sheet is discharged with a printing surface facing upward. The operation is called "face-up discharge". On the other hand, in each of the printer mode and the FAX mode, the user does not stay near the apparatus, and therefore a "face-down discharge" method in which the page order of discharged sheets is arranged is often used.

Hence, the apparatus has a mechanism capable of switching between the face-up discharge and the face-down discharge in accordance with the printing mode. The switching mechanism is configured so that a plurality of transport paths and a plurality of branch claws are arranged in an area where a sheet which has passed through the fixing unit 23 is discharged to the paper discharge tray 33, and thereby sheets are discharged in accordance with the printing mode.

Figure 2:
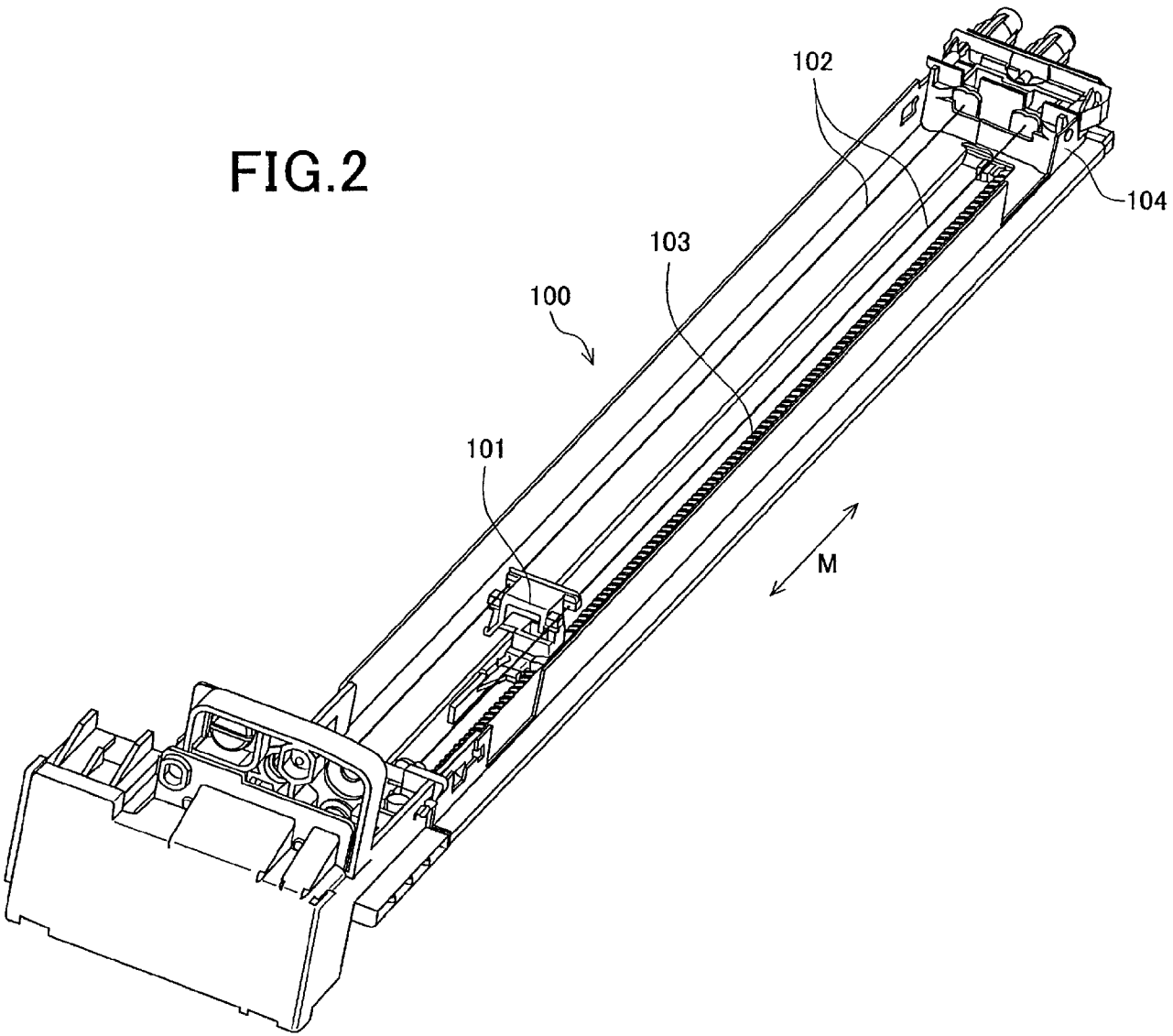
FIG. 2 is a perspective view showing an example of a charging apparatus provided in the image forming apparatus.

FIG. 2 is a perspective view showing an example of the charging apparatus provided in the image forming apparatus, where 100 denotes a charging apparatus which corresponds to the charging apparatus 19 in the image forming apparatus shown in FIG. 1. As described above, the image forming apparatus is provided with the charging apparatus 100 for uniformly charging the surface of the photoreceptor drum as an image carrier at a predetermined voltage. The charging apparatus 100 is a charger type charging apparatus wherein a high voltage is applied to a charging wire 102 as a discharge electrode so as to be subjected to corona discharge, and thereby the photoreceptor drum is charged. Here, the charging apparatus 100 as shown in FIG. 2 is fixed near the photoreceptor drum.

The charging wire cleaning apparatus according to the present invention cleans the charging wire 102 of the charging apparatus 100, and is provided within a unit of the charging apparatus 100. The cleaning apparatus for the charging wire includes a slider 101 provided with a cleaning pad which is put in press-contact with the charging wire 102 and reciprocates with respect to the charging wire 102 so as to clean the charging wire 102, and a screw shaft 103 for reciprocating the slider 101 in parallel to the charging wire 102. The slider 101 corresponds to the supporting body of the present invention and the screw shaft 103 corresponds to the moving mechanism of the present invention.

In the present embodiment, two pieces of the charging wires 102 as a discharge electrode are provided, and the charging wires 102 are stretched on a frame member 104 of the charging apparatus 100 so as to be applied with a high voltage.

In addition, the slider 101 is engaged with a screw groove of the screw shaft 103 so as to be able to be reciprocated in the direction indicated by the arrow M of FIG. 2 depending on the rotation of the screw shaft 103. The screw shaft 103 is controlled so as to be rotatable forward and in reverse by driving means such as a driving motor.

The direction indicated by the arrow M is a direction where the charging wire 102 is tensioned, and a direction matching the axis direction of the photoreceptor drum. Thereby, the charging wire 102 is arranged in parallel to the surface of the photoreceptor drum. In addition, the direction indicated by the arrow M is also a main scanning direction of scanning light for scanning the photoreceptor drum.

By the reciprocation of the slider 101, the cleaning pad attached to the slider 101 slides to clean the charging wire 102. The reciprocation of the slider 101 can be carried out by performing a predetermined operation for an operation input portion of the image forming apparatus. Such a cleaning operation of the charging wire 102 is executed by, for example, a service person who performs maintenance of the image forming apparatus.

Figure 3:
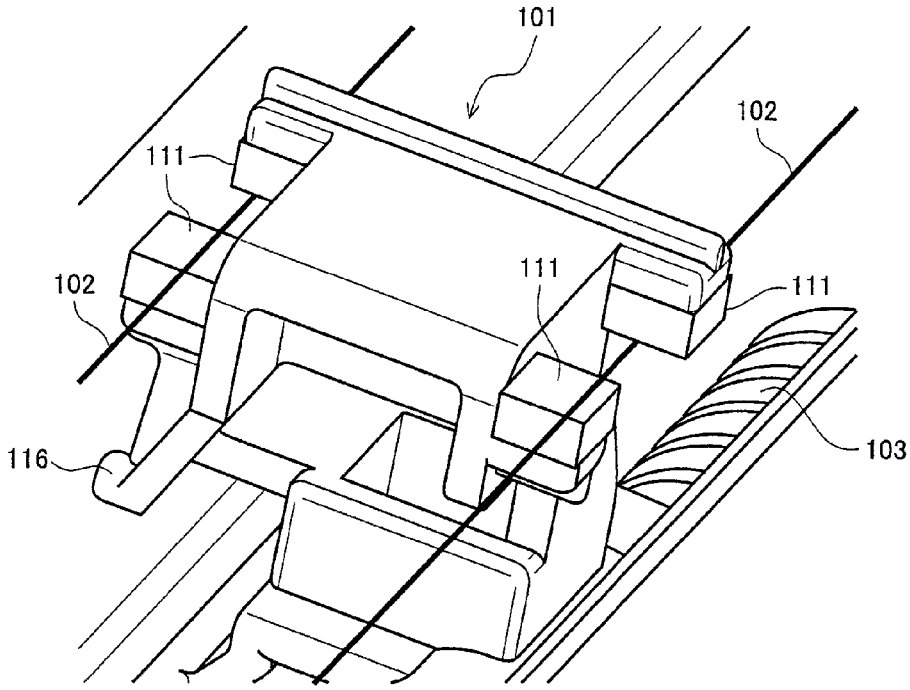
FIG. 3 is a perspective view showing a slider of the charging wire cleaning apparatus.

FIG. 3 is a perspective view showing the slider of the charging wire cleaning apparatus. The slider 101 is provided with a cleaning pad 111 for cleaning the charging wire 102. Two pieces of the cleaning pads 111 are provided for one charging wire 102 so as to be brought into contact with the charging wire 102 in two positions. In addition, since the two pieces of the cleaning pads 111 are provided for the two pieces of the charging wires 102, respectively, the slider 101 is attached with four pieces of the cleaning pads 111 in total.

A foot portion 116 is used to shift the cleaning pad 111 being in contact with the charging wire 102 in the direction orthogonal to the wire 102. Moreover, a contact face where each cleaning pad 111 is brought into contact with the charging wire 102 is processed so as to coincide with a horizontal plane. The horizontal plane herein is a plane including a direction in which the cleaning pad 111 supported by the slider 101 reciprocates and a direction in which the cleaning pad 111 is shifted. A mechanism for causing the cleaning pad 111 to be shifted will be described below.

The two pieces of the cleaning pads 111 are brought into contact with one charging wire 102 in the formation so as to sandwich the charging wire 102 from the upper and lower sides of the charging wire 102 at positions separated each other. That is, the two pieces of the cleaning pads 111 are arranged so that one of the cleaning pads 111 is brought into contact with the charging wire 102 from one side, and the other cleaning pad 111 is brought into contact with the charging wire 102 from an opposite side.

In this case, the cleaning pads 111 are in a state of being press-contact with the charging wire 102. By rotating the screw shaft 103 to reciprocate the slider 101, it is possible to clean the charging wire 102.

Figure 4:
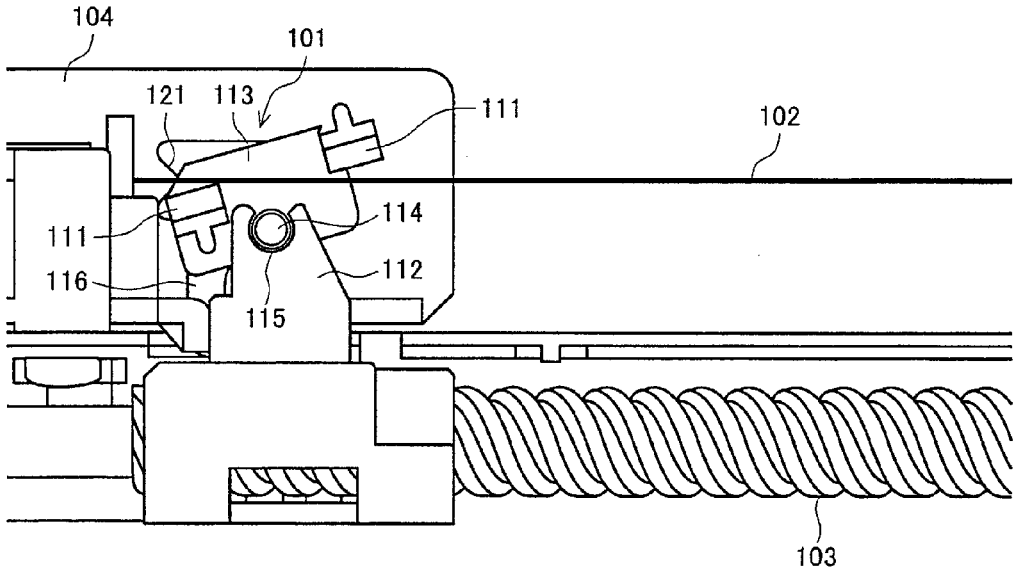
FIG. 4 is a view illustrating the structure of the slider of the charging wire cleaning apparatus more specifically.

FIG. 4 is a view illustrating the structure of the slider of the charging wire cleaning apparatus more specifically. The slider 101 is made of a base portion 112 which is engaged with the screw shaft 103 and reciprocates depending on the rotation of the screw shaft 103, and a head portion 113 which is supported so as to be rotatable with respect to the base portion 112. Here, the head portion 113 is provided with a support shaft 114, and supports the support shaft 114 by a bearing portion 115 of the base portion 112.

With the rotation of the head portion 113, the slider 101 can be in a state where the cleaning pad 111 is brought into contact with the charging wire 102 and a state where the cleaning pad 111 is separated from the charging wire 102.

In this case, when the slider 101 that reciprocates is positioned at one end (corresponding to a predetermined position of the present invention) of the reciprocation range thereof, the head portion 113 is rotated so that the cleaning pad 111 provided in the head portion 113 and the charging wire 102 are separated from each other. Then, when the slider 101 is started to move, the cleaning pad 111 is put in press-contact with the charging wire 102 so as to be able to clean the charging wire 102.

The rotation of the head portion 113 is carried out by the action of a protruding portion 121 which is provided in the frame member 104 of the charging apparatus 100. FIG. 4 shows a state where the cleaning pad 111 is separated from the charging wire 102, but herein the slider 101 is at the one end of the reciprocation range and the front end (the left side in the figure) of the head portion 113 is press-contact with the protruding portion 121, so that the front end side is displaced downward in accordance with the shape of the protruding portion 121. Thereby, the head portion 113 is rotated and the cleaning pad 111 is separated from the charging wire 102.

When the slider 101 is started to move and released from the engagement with the protruding portion 121, the head portion 113 is rotated, making it possible to bring the cleaning pad 111 into contact with the charging wire 102. At this time, in order to reliably rotate the head portion 113, not-shown energizing means such as a spring for energizing the head portion 113 in a direction so as to be brought into contact with the charging wire 102 is provided. Alternatively, a guide member or the like for rotating the head portion 113 to bring the cleaning pad 111 into contact with the charging wire 102 when the slider 101 is started to move may be provided in the frame member 104. The protruding portion 121 corresponds to a fixing wall portion of the present invention that acts on the head portion 113 only when the slider 101 is at the predetermined position in the reciprocation range.

Figure 5A:
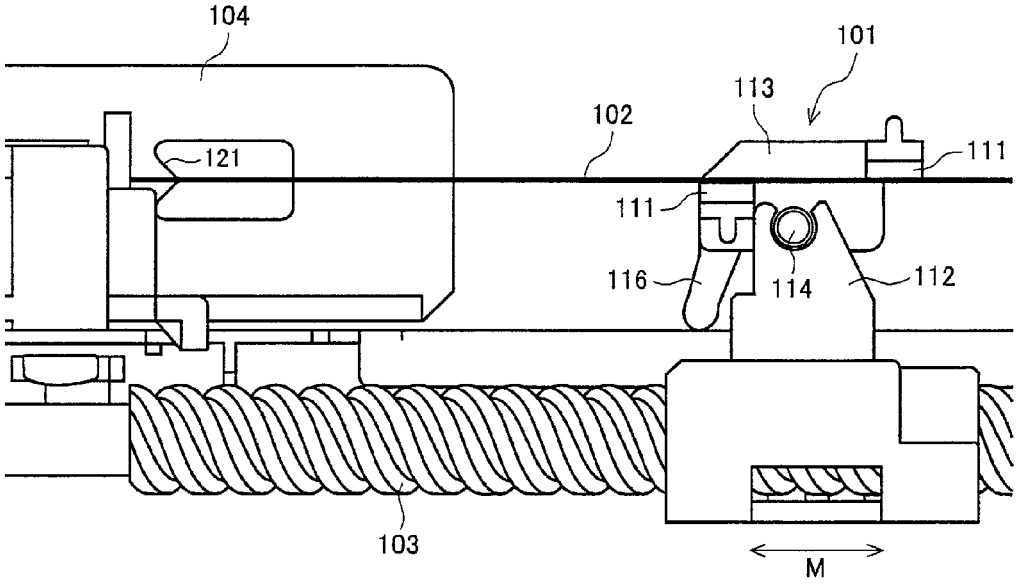
FIGS. 5A and 5B are views showing a state where a wire is being cleaned by the charging wire cleaning apparatus.
Figure 5B:
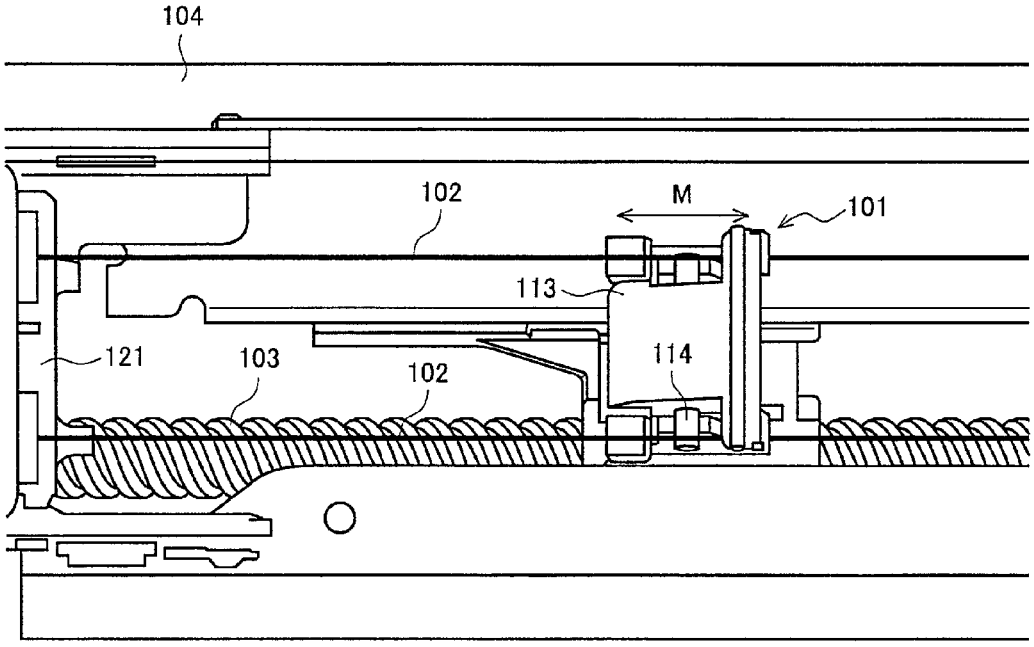

FIGS. 5A and 5B are views showing a state where a wire is being cleaned by the charging wire cleaning apparatus, where FIG. 5A is a side view of a main part of the charging apparatus provided with the charging wire cleaning apparatus, and FIG. 5B is a plan view of FIG. 5A.

By rotationally driving the screw shaft 103, the slider 101 of the charging wire cleaning apparatus reciprocates in the direction indicated by the arrow M. As described above, in the head portion 113 of the slider 101, two pieces of the cleaning pads 111 are attached to one charging wire 102, and in this state, each cleaning pad 111 is press-contact with the charging wire 102.

Moreover, in accordance with the reciprocation movement of the slider 101, the cleaning pad 111 is slid with respect to the charging wire 102 so as to clean the charging wire 102. At this time, the two pieces of the cleaning pads 111 are brought into contact with one charging wire 102 in the formation so as to sandwich the charging wire 102 from the upper and lower sides of the charging wire 102 at positions separated each other.

Figure 6A:
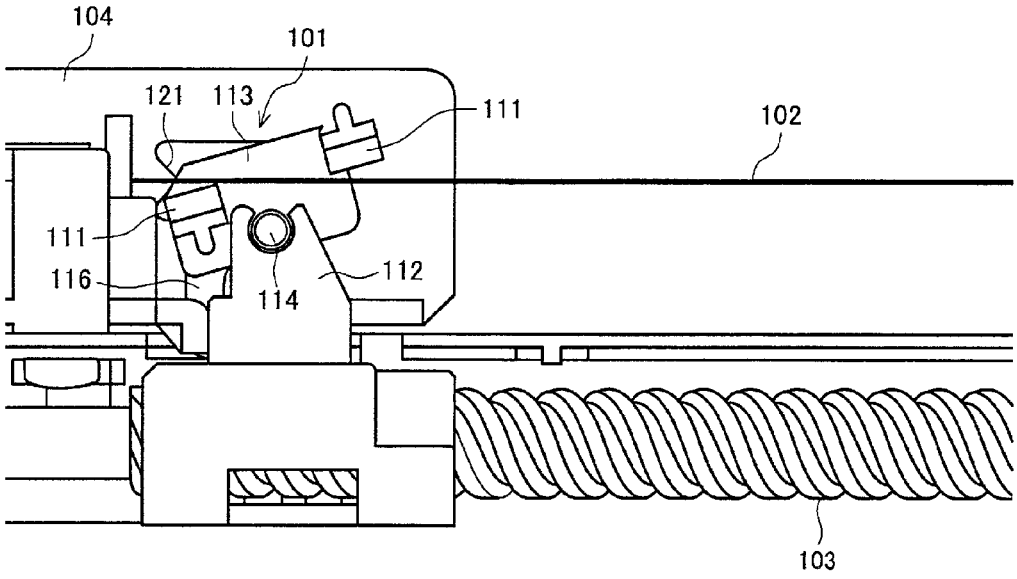
FIGS. 6A and 6B are views showing a state where the charging wire cleaning apparatus stops.
Figure 6B:
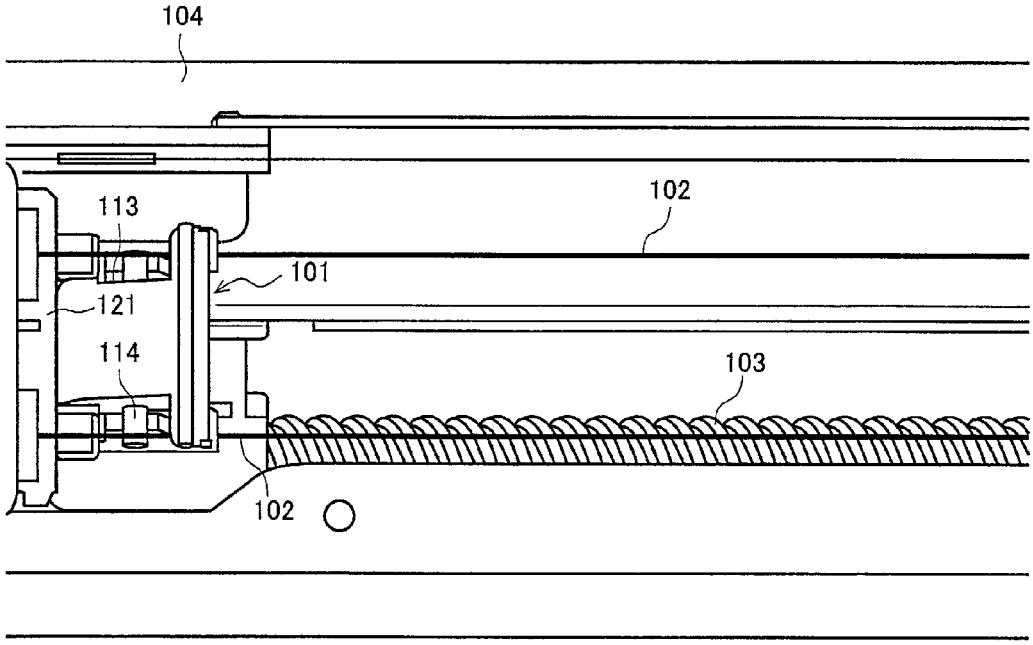

FIGS. 6A and 6B are views showing a state where the charging wire cleaning apparatus stops, where FIG. 6A is a side view of a main part of the charging apparatus provided with the charging wire cleaning apparatus, and FIG. 6B is a plan view of FIG. 6A.

In the state of FIGS. 5A and 5B, when the slider 101 which is cleaning the charging wire 102 moves and stops at one end of the reciprocation range, the head portion 113 of the slider 101 is rotated so as to bring the cleaning pad 111 out of contact with the charging wire 102. Here, as described above, the head portion 113 acts on the protruding portion 121 provided in the frame member 104 of the charging apparatus 100 and the head portion 113 is rotated, so that the cleaning pad 111 is separated from the charging wire 102.

In the embodiment according to the present invention, the cleaning pad 111 is able to be shifted in a direction orthogonal to the charging wire 102 in a state where the cleaning pad 111 is separated from the charging wire 102.

Here, it is possible to shift the head portion 113 of the slider 101 in the direction orthogonal to the charging wire 102 with respect to the base portion 112. Thus, the contact area of the cleaning pad 111 with the charging wire 102 can be shifted, and abrasion and damage in the charging wire 102 can be prevented without making a specific area of the cleaning pad 111 be in press-contact with the charging wire 102 at all times. The mechanism will be described in detail below.

FIGS. 7A to FIG. 8B are views illustrating the shift mechanism of the slider. In each figure, the charging wire 102 will be omitted for illustration.

Figure 7A:
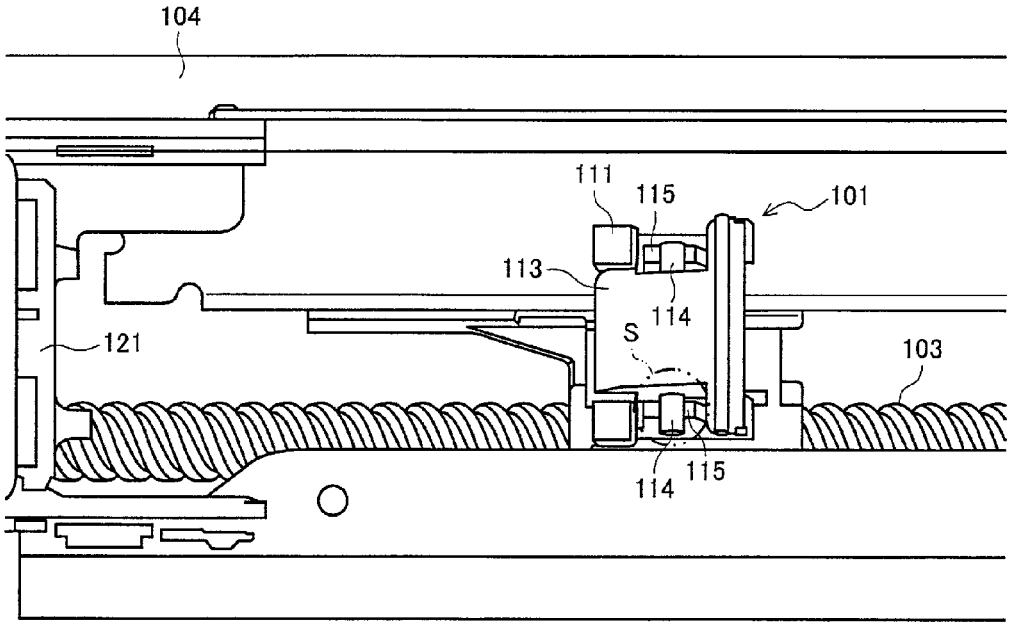
FIGS. 7A and 7B are views illustrating a shift mechanism of the slider.
Figure 7B:
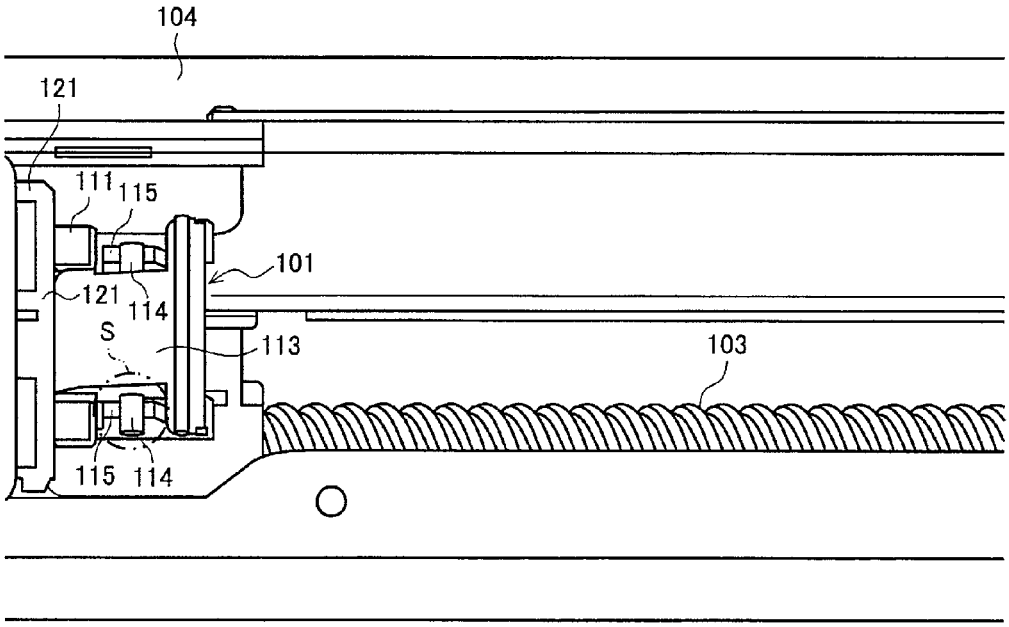

FIG. 7A is a plan view in a state where the slider 101 is cleaning the charging wire 102. As described above, the head portion 113 of the slider 101 is provided with the support shaft 114, and the support shaft 114 is supported by the bearing portion 115 of the base portion 112 so as to be rotatable. In the support shaft 114, a long axis direction thereof coincides with the orthogonal direction of the charging wire 102. In addition, the head portion 113 is adapted to be shifted in the long axis direction of the support shaft 114 with respect to the base portion 112. That is, the support shaft 114 of the head portion 113 is slidable in the axis direction thereof with respect to the bearing portion 115 of the base portion 112. In the state of FIGS. 7A and 7B, since there is a space S where the head portion 113 can be shifted between the bearing portion 115 and a wall face of the head portion 113, the head portion 113 can be shifted using this space.

FIG. 7B is a plan view in a state where the slider 101 is carried to one end of a movable range thereof and stopped. The position corresponds to the position of FIG. 4. Here, the head portion 113 is rotated by the protruding portion 121 so that cleaning pad 111 is separated from the charging wire 102.

Figure 8A:
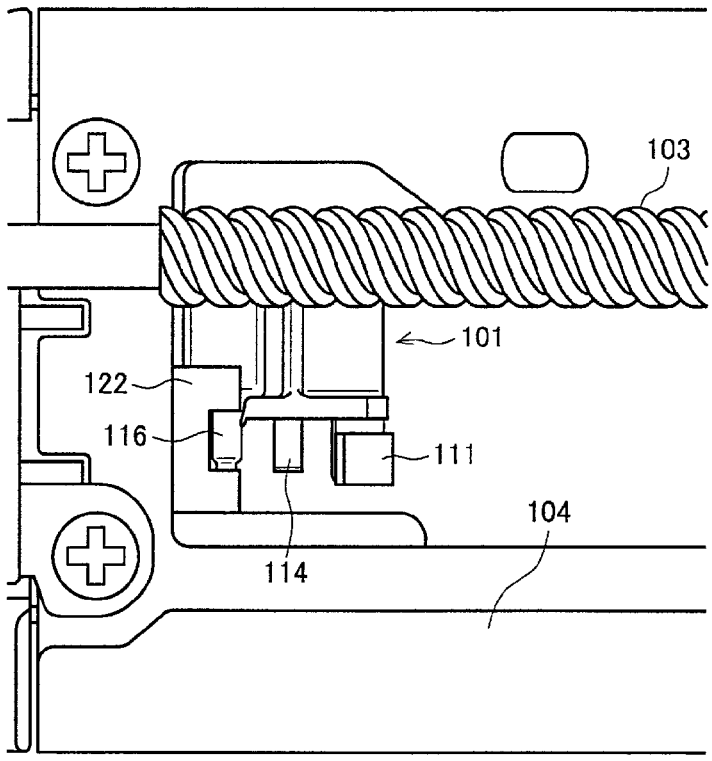
FIGS. 8A and 8B are views illustrating the shift mechanism of the slider.
Figure 8B:
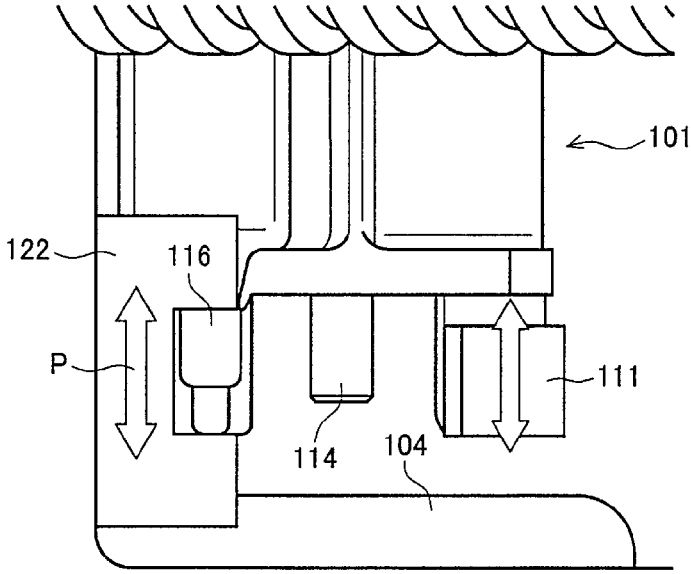

FIG. 8A is a view when the slider 101 in the state of FIG. 7B is viewed from the bottom side, and FIG. 8B is an enlarged view of a main part thereof. As described above, the head portion 113 of the slider 101 is provided with the foot portion 116 which is projected downward. In the state of FIG. 8A, the foot portion 116 is displaced downward (front side in a vertical direction to a paper surface of FIGS. 8A and 8B) depending on the rotation of the head portion 113.

On the other hand, the frame member 104 of the charging apparatus is provided with a shift operation member 122 which is engaged with the foot portion 116. The shift operation member 122 has a U-shape so as to be engaged with the foot portion 116, and can be shifted in the direction orthogonal to the charging wire 102 (the direction indicated by the arrow P in FIG. 8). Here, when a user operates the shift operation member 122, the shift operation member 122 can be shifted arbitrarily in the direction indicated by the arrow P.

Moreover, in the state of FIGS. 8A and 8B, when the head portion 113 is rotated, the lower end of the foot portion 116 is engaged with the U-shaped shift operation member 122. That is, only when the slider 101 is positioned at one end of the movable range, the shift operation member 122 is engaged with the foot portion 116 in the head portion 113. When the shift operation member 122 is shifted by the operation of the user, it is shifted while the U-shaped wall portion pushes the foot portion 116. Thereby, in accordance with the shift operation of the shift operation member 122, the head portion 113 is shifted with the shift operation member 122 and the cleaning pad 111 attached to the head portion 113 is shifted.

The aforementioned structure enables that when the slider 101 is positioned at one end of the movable range, the head portion 113 is rotated so that the cleaning pad 111 is separated from the charging wire 102, and in this state, the cleaning pad 111 is shifted by an arbitrary amount in the direction orthogonal to the charging wire 102. Since the cleaning pad 111 is shifted in a state where the cleaning pad 111 is separated from the charging wire 102, it is easy to perform the shift operation and there is no risk of causing damage to the cleaning pad 111 and the charging wire 102.

In this way, by shifting the cleaning pad 111 appropriately, it is possible to change the contact area where the cleaning pad 111 is brought into contact with the charging wire 102. Moreover, since each cleaning pad 111 has the contact face where the cleaning pad 111 is brought into contact with the charging wire 102, which is processed so as to be horizontal, even when the contact area of the cleaning pad 111 with the charging wire 102 is shifted, it is possible to execute stable cleaning operation without changing the contact state of the cleaning pad 111 with the charging wire 102.

As a result, it is possible to prevent abrasion and damage in a specific area on the cleaning pad 111, to maintain the cleaning performance, and to stabilize the charging voltage of the charging wire 102.

Figure 9A:
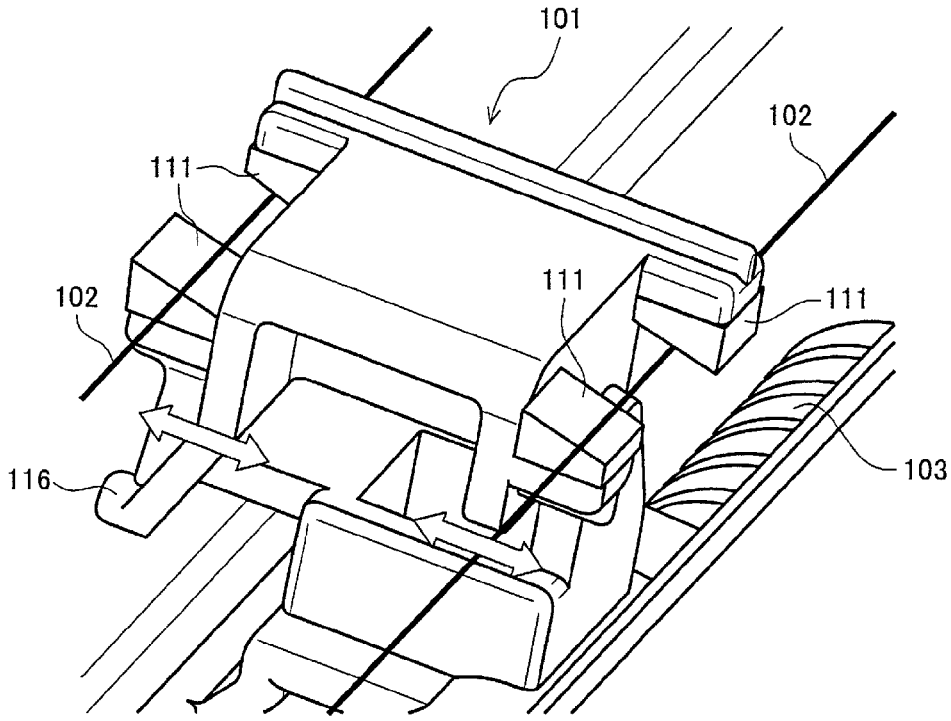
FIGS. 9A and 9B are perspective views showing another structural example of the slider of the charging wire cleaning apparatus.
Figure 9B:
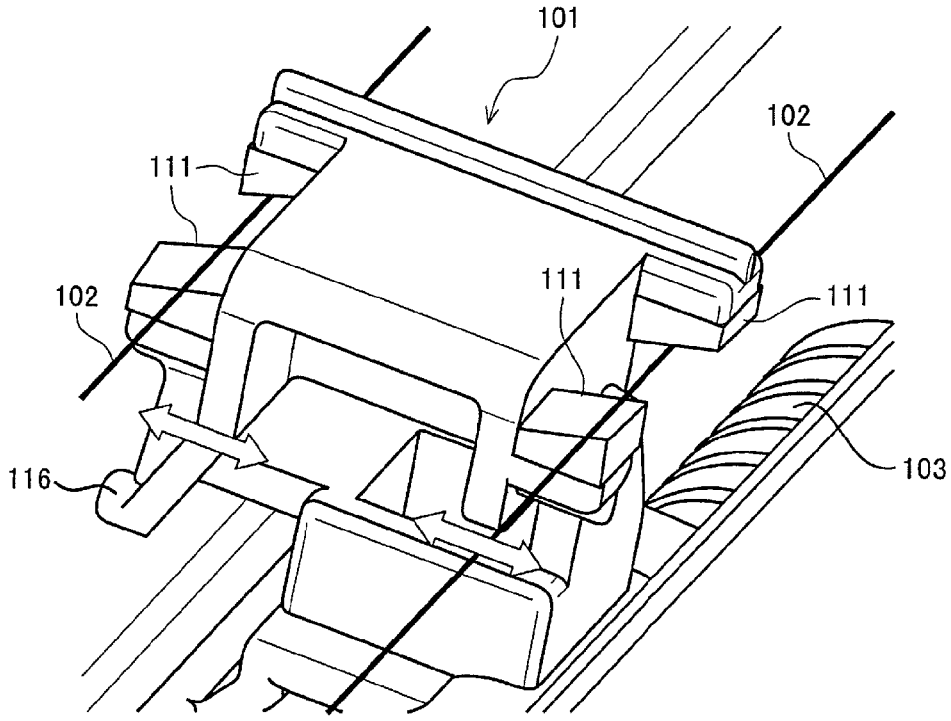

FIGS. 9A and 9B are perspective views showing another structural examples of the slider of the charging wire cleaning apparatus, and FIGS. 9A and 9B show the structure when the contact face of the cleaning pads are inclined, respectively.

In the structural examples shown in FIGS. 9A and 9B, the shapes of the cleaning pad 111 provided in the slider 101 are changed. In the examples, the contact faces where the cleaning pad 111 are brought into contact with the charging wire 102 are processed so as to be oblique to a horizontal plane. The horizontal plane is a plane including a direction in which the cleaning pad 111 supported by the slider 101 reciprocates and a direction in which the cleaning pad 111 is shifted.

In this case, four pieces of cleaning pads 111 each of which are in contact with two pieces of charging wires 102 are formed so that inclination directions of each contact face are matched with one another. Moreover, the inclination direction is matched with the orthogonal direction of the charging wire 102. Hence, the inclination direction of the cleaning pad 111 can employ any of the structure as shown in FIG. 9A and the structure as shown in FIG. 9B.

By using the slider 101 of the present embodiment, it is possible that the position of the cleaning pad 111 is shifted by the shift mechanism of the slider 101 so that the position to clean the charging wire 102 by the cleaning pad 111 is adjusted. In addition, by inclining the contact face where the cleaning pad 111 is brought into contact with the charging wire 102, there is a merit that usable period for the cleaning pad is extended as the total area of the contact face is increased.

Note that, although an example of the charging apparatus provided with two pieces of the charging wires 102 as a discharge electrode has been described in the structure of the aforementioned embodiment, it is possible to apply to a charging apparatus provided with one wire in the structure of the embodiment according to the present invention. In this case, two pieces of the cleaning pads are provided for one charging wire so that each cleaning pad is separated from the charging wire depending on the rotation of the head portion in the structure similar to that of the aforementioned embodiment. Here, by shifting the cleaning pad in a direction orthogonal to the charging wire by the shift mechanism, similar effect as that of the aforementioned embodiment can be obtained also in the charging apparatus having one charging wire.

According to the present invention, following effect can be obtained.

According to the present invention, it is possible to maintain cleaning performance of the cleaning pad to clean the charging wire and to stabilize the charging voltage of the image carrier by the charging wire.

The invention claimed is:

1. A charging wire cleaning apparatus, comprising a cleaning pad for cleaning a charging wire which charges an image carrier;

a supporting body for supporting the cleaning pad; and a moving mechanism for reciprocating the supporting body in parallel to the charging wire, wherein the charging wire cleaning apparatus has a mechanism for making the cleaning pad and the charging wire be in a separated state when the supporting body is at a predetermined position within a reciprocation range, and the supporting body is adapted to shift the cleaning pad in a direction orthogonal to the charging wire when they are separated to change a contact area of the cleaning pad where the cleaning pad is brought into contact with the charging wire in a press-contact state.

2. The charging wire cleaning apparatus as defined in claim 1, wherein two pieces of the cleaning pads are provided for one piece of the charging wire.

3. The charging wire cleaning apparatus as defined in claim 2, wherein the two pieces of the cleaning pads provided in the one piece of the charging wire are arranged so as to be brought into contact with the charging wire at a position separated each other on the charging wire, in which one of the cleaning pads is brought into contact with the charging wire from one side, and the other cleaning pad is brought into contact with the charging wire from a side opposite to the one side.

4. The charging wire cleaning apparatus as defined in claim 3, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

5. The charging wire cleaning apparatus as defined in claim 3, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

6. The charging wire cleaning apparatus as defined in claim 2, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

7. The charging wire cleaning apparatus as defined in claim 2, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

8. The charging wire cleaning apparatus as defined in claim 1, wherein the supporting body has a base portion which is reciprocated by the moving mechanism and a head portion which is pivotally supported so as to be rotatable with respect to the base portion, the cleaning pad is attached to the head portion, and depending on a rotation of the head portion, a position where the cleaning pad is brought into contact with the charging wire and a position where the cleaning pad is separated from the charging wire are taken.

9. The charging wire cleaning apparatus as defined in claim 8, wherein the mechanism that causes the cleaning pad to be separated from the charging wire has a fixing wall portion which acts on the head portion only when the supporting body is positioned at the predetermined position within the reciprocation range, and at the predetermined position, the fixing wall portion displaces the head portion in a predetermined direction so as to rotate the head portion, and thereby the cleaning pad and the charging wire are kept being in a separated state.

10. The charging wire cleaning apparatus as defined in claim 9, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

11. The charging wire cleaning apparatus as defined in claim 9, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

12. The charging wire cleaning apparatus as defined in claim 8, wherein the head portion is shiftably attached to the base portion, the charging wire cleaning apparatus has a shift operation member which can be engaged with a part of the head portion to enable a shift operation in a predetermined direction only when the supporting body is positioned at the predetermined position within the reciprocation range, and when an operation of shifting the shift operation member at the predetermined position is performed, the head portion is shifted with the shift operation member, and the cleaning pad is shifted with respect to the charging wire.

13. The charging wire cleaning apparatus as defined in claim 12, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

14. The charging wire cleaning apparatus as defined in claim 12, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

15. The charging wire cleaning apparatus as defined in claim 8, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

16. The charging wire cleaning apparatus as defined in claim 8, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

17. The charging wire cleaning apparatus as defined in claim 1, wherein when a plane including a direction in which the cleaning pad supported by the supporting body reciprocates and a direction in which the cleaning pad is shifted is a horizontal plane, a plane where the cleaning pad is brought into contact with the charging wire coincides with the horizontal plane.

18. The charging wire cleaning apparatus as defined in claim 1, wherein when a plane including a direction in which the cleaning pad supported by the supporting body reciprocates and a direction in which the cleaning pad is shifted is a horizontal plane, a plane where the cleaning pad is brought into contact with the charging wire is inclined to the horizontal plane.

* * * * *